United States Patent [19]

Gibson

[11] 3,955,811

[45] May 11, 1976

[54] PAPER STACK HEIGHT CONTROL IN A MULTIBIN COPIER

[75] Inventor: David K. Gibson, Boulder, Colo.

[73] Assignee: International Business Machines Corporation, Armonk, N.Y.

[22] Filed: Mar. 3, 1975

[21] Appl. No.: 555,018

[52] U.S. Cl. ..... 271/9; 271/117; 271/126; 271/155

[51] Int. Cl.[2] ..... B65H 1/18; B65H 3/44

[58] Field of Search ..... 271/9, 152, 153, 154, 271/155, 157, 158, 159, 126, 118, 117, 31, 130, 156

[56] References Cited

UNITED STATES PATENTS

| | | | |
|---|---|---|---|
| 2,506,628 | 5/1950 | Belluche et al. | 271/152 |
| 3,402,928 | 9/1968 | Redoing | 271/155 |
| 3,768,806 | 10/1973 | Reehil | 271/155 |
| 3,820,777 | 6/1974 | Reehil | 271/155 |

OTHER PUBLICATIONS

Goff, W. Jr., "Multiple-Hopper Paper Feed," *IBM Technical Disclosure Bulletin*, Vol. 14, No. 9, Feb. 1972, p. 2786.

*Primary Examiner*—John J. Love
*Assistant Examiner*—Bruce H. Stoner, Jr.
*Attorney, Agent, or Firm*—Francis A. Sirr

[57] ABSTRACT

A xerographic copier having a plurality of copy sheet supply bins wherein the bin paper stacks not currently in use are lowered to an intermediate position until such later time whereat a different stack is selected for use. A sensing switch senses the top of each non-used stack and bidirectionally maintains the stack at its intermediate level. Swelling of the paper stack, due to humidity and the like, causes the stack's elevator platform to lower under the control of the sensing switch. This sensing switch also senses the top of the stack when the stack is in use, and bidirectionally maintains the top of this stack at a higher sheet feed position. These two sensing functions are provided by a single pivoted member which engages the top sheet of the stack. This pivoted member controls a switch means. The selection of a stack causes a change in the physical position of the pivot and the switch means for this stack. This positional change causes the top sheet of this stack to be elevated to the sheet feed position.

9 Claims, 5 Drawing Figures

PAPER STACK HEIGHT CONTROL IN A MULTIBIN COPIER

BACKGROUND AND SUMMARY OF THE INVENTION

Copying apparatus is known having multiple cut sheet supply bins, one of which is used at a time, the other bin being placed in an inoperative condition. Specifically, the top sheet of the stack in use is maintained at the proper sheet-feed level, while the other stack is lowered to the lowermost position whereat, for example, the supply of sheets can be restocked.

With this arrangement, the selective changing from one stack to the other, as when changing copy sheet size, requires a relatively long time period during which the previously unused stack must be elevated from its lowermost bottom position to its top position.

The present invention shortens this change time by interposing an intermediate position, closely spaced from the feed position, so that a previously unused stack is quickly available. In addition the vertical position of all sheet stacks is bidirectionally controlled so that stack swelling, due to humidity and the like, does not inadvertently place more than one stack at its sheet feed position, while at the same time insuring that the top sheet of the used stack neither undershoots nor overshoots the sheet feed position.

In a specific embodiment, the sheet feed position and the intermediate position of the top sheet of a stack is selectively provided by a pivoted member which physically engages the top sheet and controls a switch means. By changing the positional relationship of this member's pivot and the switch means, in accordance with a desire to use or not use the stack, the top sheet thereof is bidirectionally controlled to be at the sheet-feed position or is bidirectionally controlled to be at a lower intermediate position. When a stack is to be replenished, it is lowered to a lowermost position.

The foregoining and other features and advantages of the invention will be apparent from the following more particular description of preferred embodiments of the invention, as illustrated in the accompanying drawing.

DESCRIPTION OF THE PREFERRED EMBODIMENT

Figure 1:
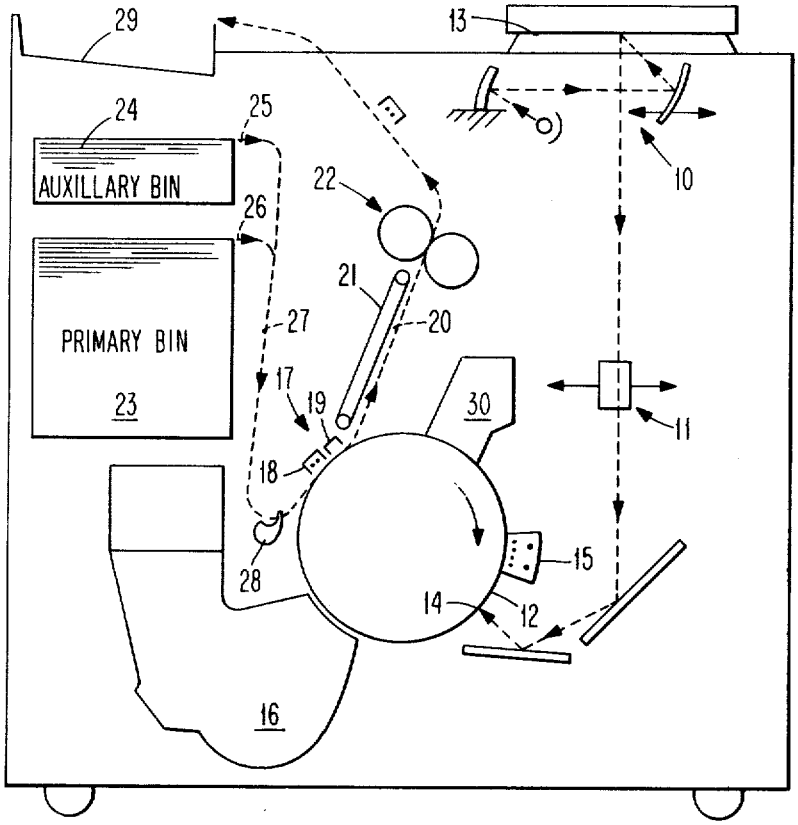
FIG. 1 is a schematic view of a multiple bin xerographic copying apparatus incorporating the present invention.

FIG. 1 is a schematic view of a multiple bin xerographic copying apparatus incorporating the present invention. In this device a scanning mirror system 10 and a moving lens 11 operate in synchronism with the rotation of photoconductor drum 12 to place a latent image of an original document 13 onto the drum's surface. As is well known, prior to imaging at 14 the drum is charged by corona 15. After imaging, the drum's latent image is developed by magnetic brush developer 16. Thereafter the drum's toned visible image is transferred to a sheet of copy paper at transfer station 17. This transfer station includes transfer corona 18. Sheet detach means 19 thereafter operates to cause the now toned sheet to leave the surface of the drum and to follow sheet path 20, adjacent vacuum conveyor 21 on its way to hot roll fuser assembly 22. After fusing, the finished copy sheet is deposted in tray 29. After transfer, the drum is cleaned as it passes cleaning station 30.

Figure 5:
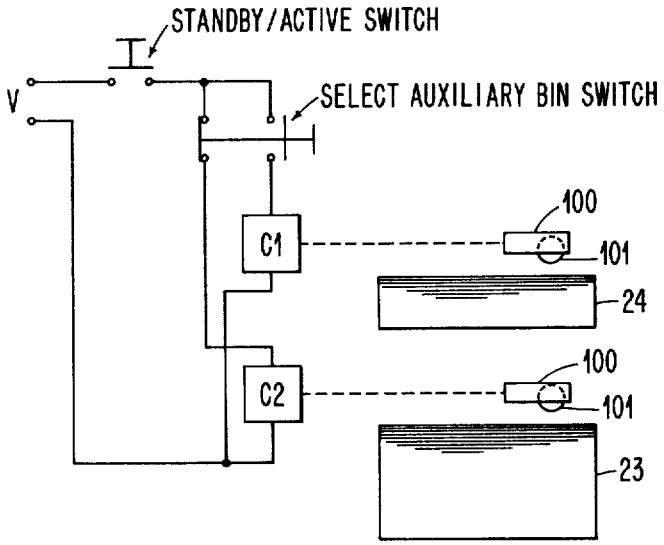
FIG. 5 is an exemplary conrol circuit whereby control means in the form of a standby/active switch is operable in its standby state to activate all sheet supply sources to maintain the top sheet of all sources at a position which is between a paper feed position and a paper load position, and whereby further control means in the form of a select auxiliary bin switch is operable, when the standby/active switch is in its active state, to maintain the top sheet of the selected source at the paper feed position.

The apparatus of FIG. 1 includes two copy sheet supply bins 23 and 24. Primary bin 23 contains cut sheet stock of the type, i.e. size and/or weight, normally selected for use. Auxiliary bin 24 contains cut sheet stock of the type which is infrequently used. Supply bins 23 and 24 include a bidirectional vertically movable elevator which supports the bottom sheet of the stack. While this structure is well known to those of skill in the art, an exemplary structure of this type is described in the IBM TECHNICAL DISCLOSURE BULLETIN of August 1974, at pages 670 and 671. Operator select means such as, for example, push buttons for example as shown in FIG. 5, are actuated to select one or the other of bins 23 and 24. The selected bin is operable to feed the top sheet of the stack to sheet discharge path 25 or 26. This sheet then travels down sheet path 27 to be momentarily stopped at gate 28. When the leading edge of the drum's toned image arrives at the vicinity of the gate, the gate is opened to allow the sheet to progress into transfer station 17 in exact registry with the drum's image. An exemplary means of picking the top sheet from the selected bin is described in the IBM TECHNICAL DISCLOSURE BULLETIN of February 1974, at pages 2966 and 2967.

Figure 2:
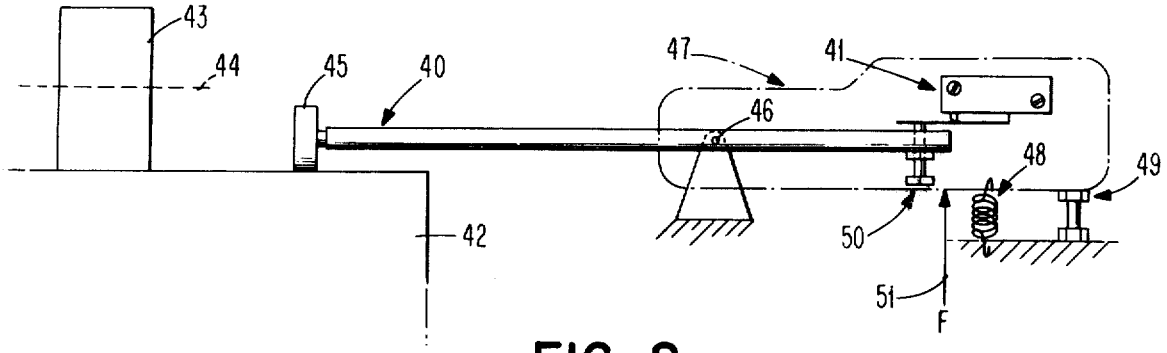
FIG. 2 discloses a first embodiment of a paper height sensor constructed in accordance with the teachings of the present invention and usable to control the sheet stack height of the primary and auxiliary bins of FIG. 1.

FIG. 2 discloses an embodiment of the present invention wherein pivoted link 40 operates double switch 41 to control the height of the top sheet of sheet stack 42. Switch 41 includes the down-increment and up-increment switches of FIG. 3. A mechanism as shown in FIG. 2 is used in each of the bins 23 and 24 to control the height of their respective sheet stacks. Picker wheel 43 rotates about axis 44 and operates to feed the top sheet into sheet path 27, as described in the above-mentioned IBM TECHNICAL DISCLOSURE BULLETIN article of February 1974. Feeler 45 is mounted on the end of link 40 and lightly engages the top sheet. This feeler is placed as close as practical to the contact area between the top sheet and picker roll 43, so that paper curl and the like will result in as little variation as possible between the paper height as sensed by feeler 45 and as picked by roll 43. It may in fact be desirable to rotate link 40 ninety degrees from that shown in FIG.

2, so that its feeler end can freely extend through a circumferential slot formed in the surface of th picker roll, thereby insuring contact in the same sheet area.

As shown in FIG. 2, the mechanism is as it appears when stack 42 is selected for use. As can be seen from FIG. 2, link 40 is pivoted at 46, as is switch plate 47. This switch plate is biased by spring 48 to engage screw adjusted stop 49 when sheet stack 42 is selected for use. As the top sheet is periodically fed into sheet path 27 of FIG. 1, link 40 pivots counterclockwise about pivot 46. This pivoting action causes adjustable end 50 of the link to actuate switch 41.

Switch 41 contains two normally open switches. These switches are identified as up-increment switch 109 and down-increment switch 117 in FIG. 3. The above-described counerclockwise rotation of link 40 operates to close switch 109, whereas clockwise rotation of the link would have operated to close switch 117.

Figure 3:
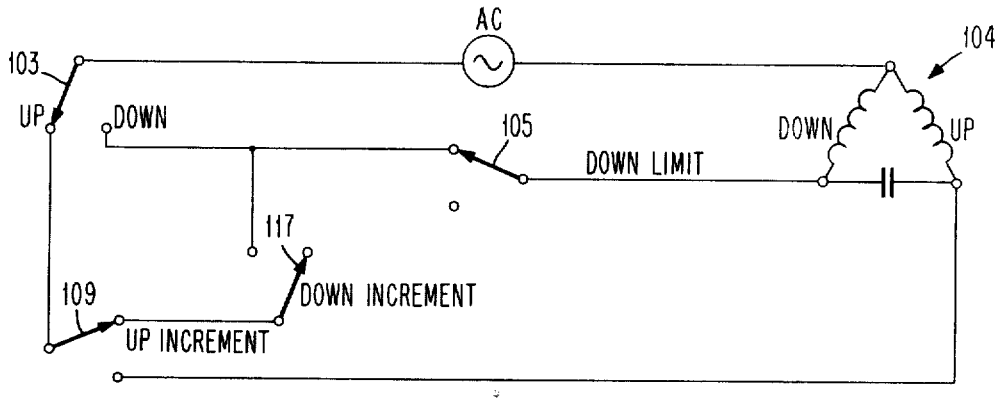
FIG. 3 discloses a control circuit which includes a down-increment and an up-increment switch of FIG. 2, and the motor which is used to control the bin elevator of one of the two bins shown in FIG. 1.

Referring to FIG. 3, motor 104 is a reversible motor which operates to control the elevator platform upon which sheet stack 42 rests. This motor may in fact be the reversible motor described in the abovementioned IBM TECHNICAL DISCLOSURE BULLETIN of August 1974. Switch 103 is an operator controlled switch which is placed in the "down" position only when it is necessary to restock the paper bin. Normally, this switch is in the "up" position, as shown. Likewise, down limit switch 105 is normally in the closed position, as shown, and operates with switch 103 in the "down" position to de-energize motor 104 when the associated paper elevator has been lowered to its lowermost position whereat the paper supply can be replenished.

If the sheet stack height of the associated stack is proper, switches 109 and 117 are as shown, and motor 104 is de-energized. If the stack height decreases, link 40 rotates in a counterclockwise direction, switch 109 transfers and motor 104 is energized in a sense to raise the stack until switch 109 again transfers, to assume the position shown. If the stack height increases, link 40 rotates in a clockwise direction, switch 117 transfers and motor 104 is energized in a sense to lower the stack until switch 117 again transfers, to assume the position shown.

Returning again to FIG. 2, when the apparatus of FIG. 1 is returned to the standby condition, i.e. no copies are requested, both sheet stacks are lowered to the intermediate position. In this position the top sheet of the stack is lowered a short distance below sheet discharge paths 25 and 26, for example a distance of 0.15 to 0.20 inch. This intermediate position provides positive clearance between the paper and the picker roll, while minimizing the time required to reposition the sheet stack in an operating position. However, this close spacing requires accurate height control during ambient height variations which may occur due to swelling of the paper stack as a result of humidity changes and the like.

This change in stack height is achieved by altering the physical relationship between pivot 46 and switch 41. This is specifically accomplished, and without limitation thereto, by a lifting force 51 which is applied to switch plate 47, causing the switch plate to lift a distance off stop 49. This force may be applied, for example, by de-energization of the bin selecting clutches described in the above-mentioned IBM TECHNICAL DISCLOSURE BULLETIN of February 1974. The initial effect of this change in physical relationship is to cause switch 117 (FIG. 3) to transfer. As above described motor 104 now lowers paper stack 42 until switch 117 again transfers, to assume the position shown. When this has been accomplished, the stack height has been lowered to its intermediate position and the control circuit again assumes the condition shown in FIG. 3. Thereafter, the top sheet of the stack is accurately maintained at this intermediate position, spaced a short distance from the bin's sheet discharge path.

Also, as described in this IBM TECHNICAL DISCLOSURE BULLETIN, deenergization of a bin selecting clutch is operable to raise picker wheel 43 off the top of stack 42. Conversely, picker wheel 43 is lowered onto the stack, and force 51 is removed, by energization of the related bin selecting clutch.

Upon a subsequent request for a copy, the selected bin, usually bin 23, has its clutch energized, thereby removing force 51. As a result the top sheet of the selected bin is quickly moved from the intermediate position to the sheet feeding position as a result of the operation of switch 109.

Primary and auxiliary bins 23 and 24 may be identical to one another except that the primary bin is deeper giving it greater paper holding capacity. Each bin includes a paper drawer having a bottom plate or platform which is elevated to bring the stack of sheets placed thereon to a level whereby the topmost sheet may be fed therefrom by the associated picker wheel and sheet forwarding mechanism, as described in the above-mentioned IBM TECHNICAL DISCLOSURE BULLETIN article of August 1974.

As described in that article, each of the bins 23 and 24 includes a picker wheel adapted to directly engage the top sheet of the stack. A clutch is provided for each of the bins. Energization of a clutch is operable to select a bin for use, and is operable to lower a picker wheel onto the top sheet of the selected bin.

Figure 4:
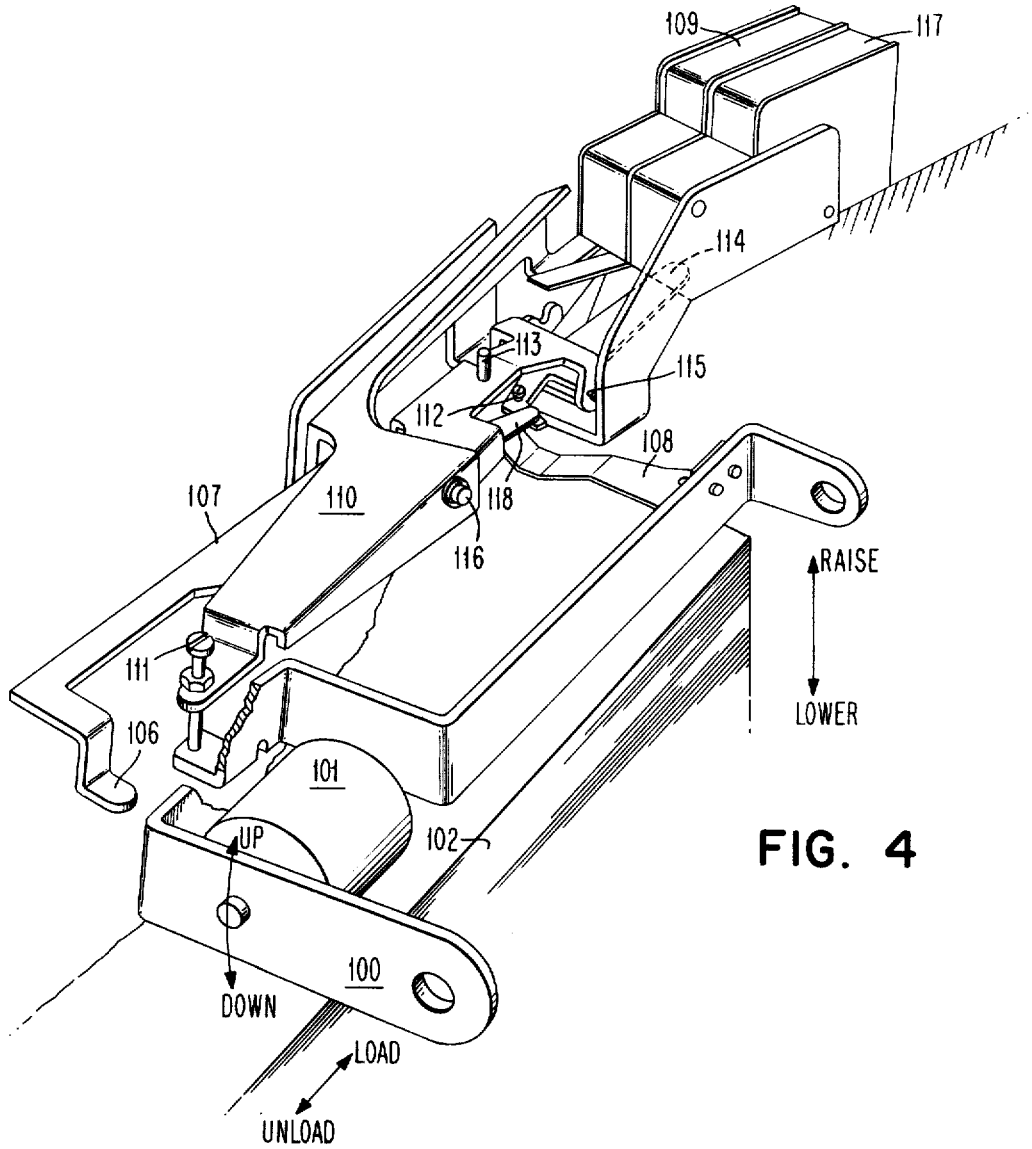
FIG. 4 discloses a second embodiment of a paper height sensor constructed in accordance with the teachings of the present invention and usable to control the sheet stack height of the primary and auxiliary bins of FIG. 1 through operation of the control circuit of FIG. 3.

With reference to FIG. 4, a second embodiment of the present invention is shown wherein energization of the clutch associated with that bin causes picker truck 100 to be lowered onto the top sheet of stack 102, much as picker wheel 43 is lowered onto stack 42, as above described. This stack may constitute either the main or the auxiliary stack. When stack 102 is selected, picker truck 100 pivots downward thereby placing picker wheel 101 on the top sheet of stack 102. As previously described, sheet stack 102 rests on an elevator platform, the platform being raised and lowered under the power of the reversible motor in FIG. 3. When the platform is in its lowermost position, as by switch 103 of FIG. 3 being manually placed in its "down" position, sheets may be loaded or unloaded therefrom in the well known manner. Once a stack of sheets has been loaded onto the elevator platform, switch 103 of FIG. 3 is manually placed in the "up" position to provide a signal to initially raise the stack upward, to position the top sheet thereof at an intermediate level. The height of paper stack 102 is sensed during times the paper is not being fed so as to provide a signal to drive the stack downward should the stack swell above the intermediate level, and to remove that signal when the stack has been driven downward again to the intermediate level. When the bin is selected, paper stack 102 is driven vertically from its intermediate position to a feeding position, above the intermediate position. As sheets are fed to the right by picker wheel 101, the top of the stack drops and a signal is provided to raise the stack and thereby maintain the topmost sheet at the feeding position. When the bin is no longer selected, the stack's top sheet is lowered to the intermediate level. There are thus three principal modes of operation: unload and load, paper feed, and non-feed.

To unload stack 101, picker truck 100 is raised (or has previously been raised) to the "up" position by means not shown and the stack is lowered by means of manually operated switch 103 (see FIG. 3). Operation of switch 103, which must be held closed by the operator as the stack lowers, energizes bin elevator motor 104 through down-limit switch 105. Downward drive is applied to the elevator platform until limit switch 105 is transferred stopping motor 104. Stack 102 can now be loaded or unloaded.

Referring again to FIG. 4, as the stack lowers, point 106 on link 107 is no longer held up by the stack and therefore link 107 pivots under the force from truck spring 108 until the opposite end of link 107 transfers the up-increment switch 109.

Once the paper stack is loaded, manually operated switch 103 is manually transferred to provide a circuit through up-increment switch 109, FIG. 3. This causes bin motor 104 to raise stack 102 until point 106 is engaged by the top sheet. This engagement causes link 107 to rotate and retransfer up-increment switch 109 stopping the raising motion. The top of the stack is now stopped at an intermediate position below that required to feed sheets from the stack.

Following a load cycle or following a non-feed mode, paper feed is initiated by manual operation of a bin select switch, for example as shown in FIG. 5, followed by manual operation of a start button, also not shown. These switches effect lowering of picker truck 100 until picker wheel 101 rests on the top sheet of paper stack 102. Up-increment switch link 110 is spring loaded in a direction to follow the motion of the picker truck through adjusting screw 111. If the stack is too low, link 110 transfers up-increment switch 109 causing stack 102 to raise to a position suitable to feed paper from the stack. This position is defined as the position where link 110 retransfers the up-increment switch thereby stopping the raising motion. As the height of the stack decreases, due to paper feedout, switch 109 again transfers signalling motor 104 to raise the stack until the switch retransfers and de-energizes the motor. During the paper feed mode, link 107 is spring loaded in a direction to move point 106 away from the paper and thus provide complete freedom of the top sheet. Adjustment screw 111 is provided to allow adjustment of the physical relationship of switch 109 to the position of picker wheel 101.

In the non-feed mode of operation, when stack 102 is not selected, picker truck 110 is raised, thereby moving picker wheel 101 out of contact with stack 102 so that as the picker wheel rotates it will not feed paper.

As the picker truck moves upward, picker truck spring 108 contacts adjustment screws 112 and 113, rotating links 114 and 107 about pivot shafts 115 and 116, respectively. The lifting force of spring 108 is much the same as force 51 of FIG. 2 in that the raising of picker wheel 101, due to deenergization of the bin selecting clutch, is operable to apply this force.

Link 114 is spring loaded relative to link 107 in the direction toward down-increment switch 117 so as to hold switch 117 in the transferred position. Screw 113 is adjusted relative to screw 112 so that as truck spring 108 moves upward it will contact adjustment screw 113 before it contacts screw 112, rotating link 114 away from switch 117 allowing the switch to transfer, thereby providing a circuit to drive the paper stack downward.

Continued upward motion of picker truck 100 brings spring 108 in contact with screw 113, forcing link 107 to apply pressure at point 106 on the top sheet of paper stack 102. As the paper stack moves downward, spring 108 moves both links 107 and 114 upward until spring 118 retransfers switch 117 by pivoting link 114, thereby stopping the downward motion of the paper stack at the intermediate level. Spring 108 continues to apply pressure on the sheet stack throught link 107.

If the height of the paper stack increases, pressure is applied at point 106 rotating link 107 about its pivot deflecting spring 108 and retransferring switch 117, thereby providing a signal to drive the paper downward to its intermediate level where it is stopped by the motion of link 107 as point 106 follows the stack down, thereby causing link 114 to retransfer switch 117.

FIG. 5 discloses an exemplary circuit whereby auxiliary bin 24 or primary bin 23 is selected. The position of picker truck 100, picker wheel 101 and spring 108 (see FIG. 4) is controlled by clutches C1 and C2, respectively, as described in the above-mentioned IBM TECHNICAL DISCLOSURE BULLETIN of February 1974. (Just as the position of picker wheel 43 and switch plate 47 of FIG. 2 are controlled by a bin selecting clutch.) The standby/active switch, when open places the copying apparatus in the standby condition. In this condition, both picker trucks 100 are raised, and the respective sheet stacks are maintained in their intermediate positions, as above described.

When the copying apparatus is placed in the active condition, as by closing the standby/active switch, clutch C2 and primary bin 23 are normally selected. If auxiliary bin 24 is to be used, it must be manually selected, whereupon clutch C1 is energized to the exclusion of clutch C2. The energized clutch lower its picker truck 100, picker wheel 101 and spring 108 (see FIG. 4) and causes the selected sheet stack to raise to its feeding position.

While the invention has been particularly shown and described with reference to peferred embodiments thereof, it will be understood by those skilled in the art that various changes in form and details may be made therein without departing from the spirit and scope of the invention.

What is claimed is:

1. In a copying apparatus wherein visual images are transferred to sheets of material, and wherein said sheets are selectively supplied from one of a number of sheet supply sources to a sheet transport path, each such source comprising:

an elevator assembly operable to control the position of the top sheet of the sheet stack thereon;

motive means connected to move said elevator assembly;

first sensing means cooperating with the top sheet of said stack when the stack is selected and operable to control said motive means so as to maintain the top sheet in operable relation to said sheet transport path;

control means operable to cause said motive means to lower said elevator assembly to a bottom position; and second sensing means cooperating with the top sheet of said stack when the stack is not selected and operable to control said motive means so as to maintan the top sheet at a position which is between said operable position and the position assumed when said elevator assembly is at said bottom position.

2. The copying apparatus defined in claim 1, wherein first sensing means comprises a sensing means capable of detecting that the top sheet of said stack is on one side or the other of an operable relation to said sheet transport path, and operable to bidirectionally control said motive means in a manner to maintain the top sheet of said stack in operable relation to said sheet transport path.

3. The copying apparatus defined in claim 2, wherein said first sensing means includes means mechanically engaging the top sheet of said stack, and two switches controlled thereby, each switch being actuated when the top sheet of said stack is on one side or the other, respectively, of an operable relation to said sheet transport path.

4. The copying apparatus defined in claim 3, including means to pick the top sheet of said stack to cause the same to move to said sheet transport path, and wherein said means mechanically engaging the top sheet of said stack is located adjacent said means to pick the top sheet.

5. The copying apparatus defined in claim 1, including control means operable to activate the second sensing means of all sheet supply sources when the copying apparatus is in a standby condition, and further control means operable to activate the first sensing means of one selected sheet supply source when the copying apparatus is in an active condition.

6. The copying apparatus defined in claim 5 wherein said first and second sensing means comprises a single pivoted member which physically engages the top sheet of said stack and switch means mounted to be controlled by said pivoted member, and means operable to change the physical relationships between said pivot and said switch means such that with a first relationship said switch means operates as said first sensing means, and with a second relationship said switch means operates as said second sensing means, and means controlled by said further control means operable to establish said first relationship for one selected sheet supply source when the copying apparatus is in an active condition.

7. Sheet feeding apparatus comprising:

a stationary sheet discharge station;

a movable platform operable to hold a stack of sheet material;

motive means connected to move said platform;

first means connected to said motive means and operable to cause said platform to be lowered to a lowermost position to enable load/unload of said sheet material;

second means connected to said motive means and including sensing means cooperating with the uppermost sheet of the stack to maintain the same at said sheet discharge station as sheets are fed from said stack; and third means connected to said motive means and including sensing means cooperating with the uppermost sheet of the stack to maintain the same at an intermediate position a distance spaced from said sheet discharge station when said stack isin a standby condition wherat sheets are not fed from said stack.

8. Stack feeding apparatus as defined in claim 7 wherein said second means comprises a sensing means capable of detecting that the uppermost sheet of the stack is positioned at one side or the other of said sheet discharge station, and operable to bidirectionally control said motive means in a manner to maintain the uppermost sheet positioned at said sheet discharge station.

9. Sheet feeding apparatus as defined in claim 8 wherein second and third means includes a single sensing means having a pivoted member which physically engages the uppermost sheet of the stack and switch means mounted to be controlled by said pivoted member, and means operable to change the physical relationship between said pivot and said switch means such that with a first relationship said switch means operates to maintain the uppermost sheet at said sheet discharge station, and with a second relationship said switch means operates to maintain the uppermost sheet at said intermediate position.

* * * * *